US005730623A

United States Patent [19]

Krantz et al.

[11] Patent Number: 5,730,623

[45] Date of Patent: Mar. 24, 1998

[54] MATCHED IMPEDANCE TRIAX CONTACT WITH GROUNDED CONNECTOR

[75] Inventors: Leonard A. Krantz, Girard, Pa.; Lloyd G. Ratchford, Oneonta, N.Y.

[73] Assignee: Amphenol Corporation, Wallingford, Conn.

[21] Appl. No.: 551,553

[22] Filed: Nov. 1, 1995

[51] Int. Cl.[6] ..... H01R 9/05

[52] U.S. Cl. ..... 439/580

[58] Field of Search ..... 439/580, 585, 439/578

[56] References Cited

U.S. PATENT DOCUMENTS

| | | | |
|---|---|---|---|
| 2,180,923 | 11/1939 | Del Camp | 173/363 |
| 3,460,072 | 8/1969 | Ziegler | 333/33 |
| 3,492,604 | 1/1970 | Fan | 333/33 |
| 3,541,495 | 11/1970 | Ellis et al. . | |
| 3,761,844 | 9/1973 | Reeder | 333/33 |
| 4,307,926 | 12/1981 | Smith | 439/580 |
| 4,412,717 | 11/1983 | Monroe . | |
| 4,593,964 | 6/1986 | Forney, Jr. et al. | 439/580 |
| 4,728,301 | 3/1988 | Hemmer et al. | 439/578 |
| 4,799,902 | 1/1989 | Laudig et al. | 439/580 |
| 4,813,887 | 3/1989 | Capp | 439/580 |
| 4,917,630 | 4/1990 | Hubbard | 439/578 |
| 4,943,245 | 7/1990 | Lincoln | 439/578 |
| 4,990,104 | 2/1991 | Schieferly | 439/578 |
| 5,217,391 | 6/1993 | Fisher, Jr. | 439/678 |
| 5,273,458 | 12/1993 | Fisher, Jr. et al. | 439/585 |

*Primary Examiner*—Hien Vu
*Assistant Examiner*—Brian J. Biggi
*Attorney, Agent, or Firm*—Bacon & Thomas

[57] ABSTRACT

A triax cable contact provides improved high frequency performance by terminating the outer screen of the cable to an outer contact arranged to engage a ground clip in the connector and thereby ground the outer screen to the shell of the connector rather than directly to a corresponding outer contact of a mating triax contact. This permits the distance between the inner and intermediate contacts to be increased without increasing the outer diameter of the contact.

21 Claims, 4 Drawing Sheets

MATCHED IMPEDANCE TRIAX CONTACT WITH GROUNDED CONNECTOR

BACKGROUND OF THE INVENTION

1. Field of the Invention

This invention relates to the field of electrical connectors, and in particular to electrical connectors having contacts of the type known as "triax" contacts, which are contacts having coaxial inner, intermediate, and outer conductors. It will be appreciated by those skilled in the art that the term "triaxial" or "triax" is a misnomer since the contacts and cables in question actually have only a single axis, the "tri" prefix referring to the number of conductors in order to distinguish triax contacts and cables from "coaxial" contacts and cables, which only have two conductors.

2. Description of Related Art

FIG. 9 shows a typical triax cable 1 for use with the triax contact assemblies of the present invention. Triax cable 1 includes an inner conductor 2 surrounded by a first dielectric 3, which in turn is surrounded by an intermediate screen 4, a second dielectric 5, an outer screen 6, and a cable jacket 7. Although the impedances can be varied for different cables, it is common to design triax cables to have an radio frequency (RF) impedance of 50Ω between the inner and intermediate conductors, with the outer conductor being connected to ground to serve as an added shield for the "coaxial" cable formed by the inner and intermediate conductors.

In the standard triax contact assembly, electrical continuity is maintained between the front mating and rear terminating portions of the respective inner, intermediate, and outer contacts. However, in order to provide room for the respective contacts of a mating contact assembly to engage each of the inner, intermediate and outer contacts, without enlarging the overall contact assembly profile, it is necessary to vary the spacing between the individual contacts at the mating end. As a result, the space available for the respective contacts at the mating end is such that there is not enough room to maintain a specified ration between the inner diameter of the intermediate contact and the outer diameter of the inner contact, making it impossible to maintain a desired exterior profile and at the same time maintain the specified 50Ω RF impedance between the inner and intermediate contacts.

A general solution to terminate triax cables has therefore been to simply use connectors having a single contact assembly, i.e., to use SMA, OSM, and similar single contact connectors, with one connector for each cable. Of course, it would clearly be desirable to terminate multiple power cables using a single relatively small connector rather than multiple individual connectors, as is commonly done with coaxial power cables, but the above-mentioned problem of impedance matching has made it impossible to use standard circular insert type connectors for this purpose. Standard contacts used in multiple contact power connectors generally are low performance contacts with poor impedance matching, high voltage standing wave ratio (VSWR), and high insertion loss, and are not suitable for use out to Gigahertz frequencies.

While it is generally known to control the impedance between the inner and outer contacts of a coaxial connector by controlling the spacing between the inner contact and the connector shell, just as the spacing between the inner conductor and intermediate screen of the triax cable is controlled to achieve the desired RF impedance therebetween, it has heretofore been impossible to achieve similar control of the impedance between the inner and intermediate contacts of a triax contact assembly, so as to permit the use of high performance triax contact assemblies in multiple contact power connectors.

SUMMARY OF THE INVENTION

It is accordingly an objective of the invention to provide a triax contact assembly in which a desired impedance is maintained between the inner and intermediate contacts without affecting the overall profile of the contact assembly or shielding continuity of both the intermediate and outer conductors of the triax cable to which the contact assembly is connected.

It is a further objective of the invention to provide a triax contact assembly which is suitable for use in a standard multiple contact power connector, and which provides impedance matching, low VOLTAGE STANDING WAVE RATIO (VSWR), and low insertion loss out to gigahertz frequencies.

It is a still further objective of the invention to provide a triaxial contact assembly which can be used, for example, in a Mil-C-38999 Series III connector having size 12 power contacts, and yet which provides impedance matching to gigahertz frequencies.

It is yet another objective of the invention to provide an electrical connector having a plurality of triax contacts which fit within standard contact openings but which provide impedance matching to gigahertz frequencies.

These objectives are achieved, in accordance with the principles of a preferred embodiment of the invention, by establishing the continuity of the outer conductor shield through the connector shell in which the contact assembly is positioned rather than through the contact assembly itself.

By establishing continuity of the outer contact through the connector shell rather than through the contact assembly itself, the outer contact can be terminated at an intermediate portion of the contact assembly, rather than at the forward mating portion. As a result, the intermediate contact can have a larger diameter so as to make it possible to maintain a specified ratio of the inner diameter of the intermediate contact to the outer diameter of the inner contact and thereby maintain a specified impedance. By way of example, the present invention makes it possible to achieve, in a size 12 power contact suitable for use in a standard multiple contact Mil power connector, a design impedance between the inner and intermediate contacts of 50Ω to 1.6 gigahertz.

In order to be used in the standard multiple contact power connector, the standard connector needs to be modified to include a ground plate and ground clips for engaging a portion of the outer contact of the preferred contact assembly. In addition, a dielectric insert is preferably attached directly to the ground plate so as to prevent grounding to the shell of the exposed mating portion of the intermediate contact.

The preferred contact assembly may take the form either of a socket contact assembly or of a pin contact assembly. In the case of a socket contact assembly, the inner contact is a standard one piece inner contact, the outer contact is also a one piece contact but extends only partially along the contact assembly, and the intermediate contact is made up of three discrete parts, with the standard diameter rear section being electrically connected to an enlarged diameter connecting section by spring tines on the rear section, the connecting section supporting a corresponding hood section. The pin contact assembly, in contrast, has one-piece inner, intermediate, and outer contacts, but the outer contact is again terminated before the mating section of the connector, and the intermediate contact has an enlarged diameter at the mating end. In both the pin and socket contact assemblies, the outer contact includes a flange arranged to engage the spring clips in the connector and thereby provide a continuous path from one outer contact to another through the connector shell rather than through direct engagement of the outer contacts.

DETAILED DESCRIPTION OF THE PREFERRED EMBODIMENTS

The preferred embodiment of the invention includes a socket assembly 10 and a pin assembly 60 illustrated respectively in FIGS. 1–4 and 5–8.

Figure 1:
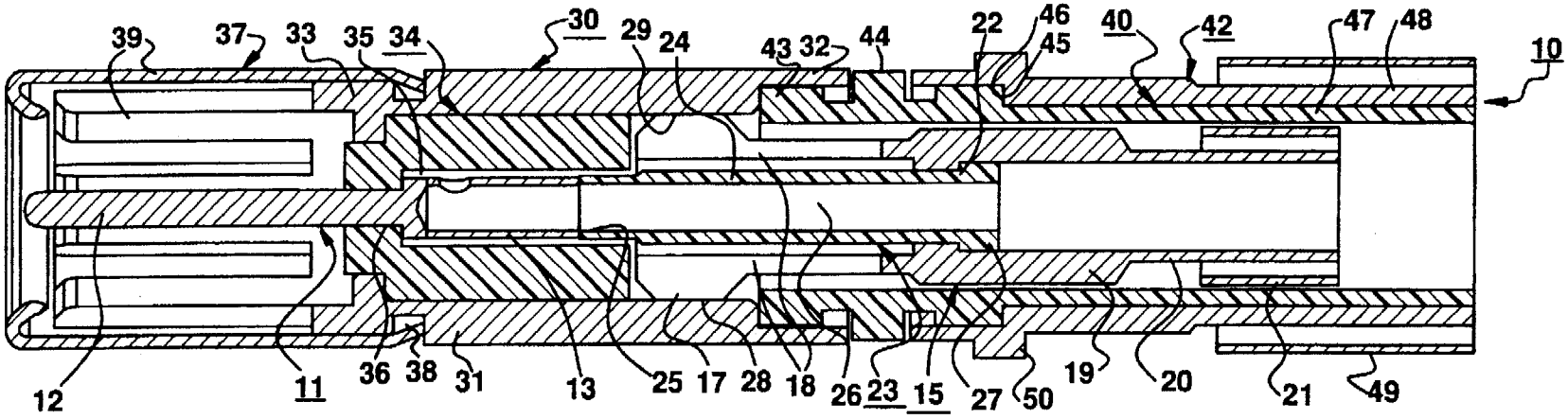
FIG. 1 is a cross-sectional side view of a triax socket assembly constructed in accordance with the principles of a preferred embodiment of the invention.
Figure 4:
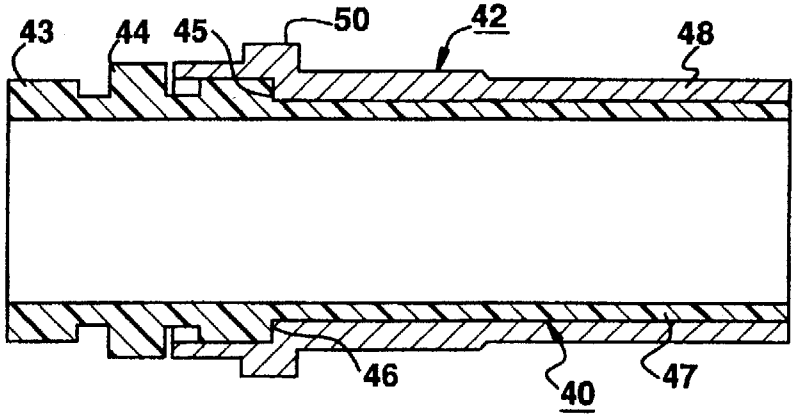
FIG. 4 is a cross-sectional side view showing the outer contact portion of the triax socket assembly of FIG. 1.
Figure 2:
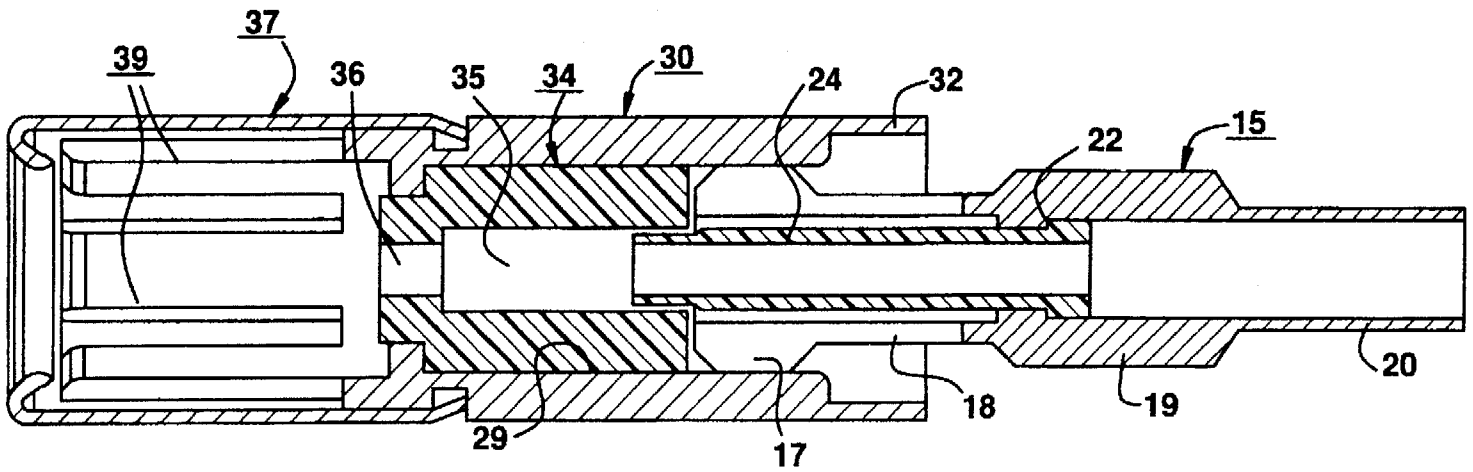
FIG. 2 is a cross-sectional side view showing the intermediate contact portion of the triax socket assembly of FIG. 1.
Figure 3:
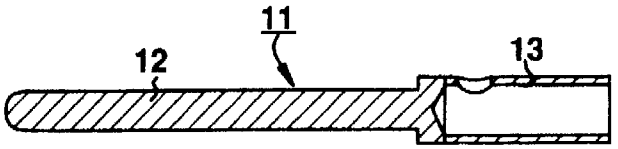
FIG. 3 is a cross-sectional side view showing the inner contact portion of the triax socket assembly of FIG. 1.
Figure 5:
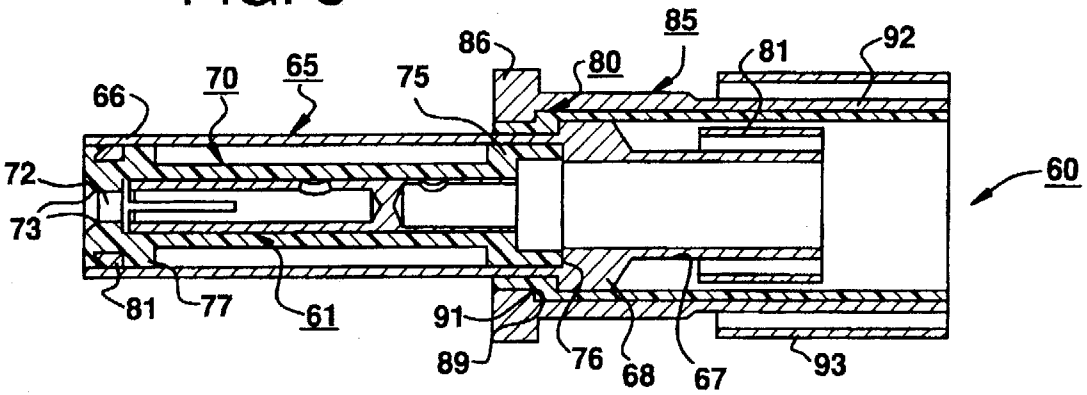
FIG. 5 is a cross-sectional side view of a triax pin contact assembly constructed in accordance with the principles of the preferred embodiment of the invention.
Figure 7:
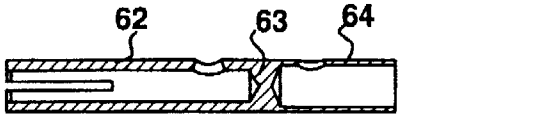
FIG. 7 is a cross-sectional side view of the inner contact portion of the triax pin assembly of FIG. 5.
Figure 9:
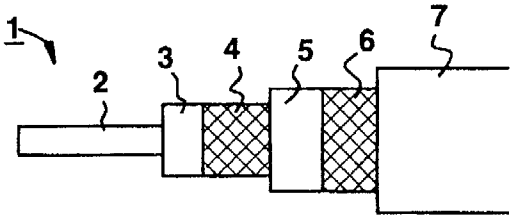
FIG. 9 is a side view of a standard triax cable.
Figure 6:
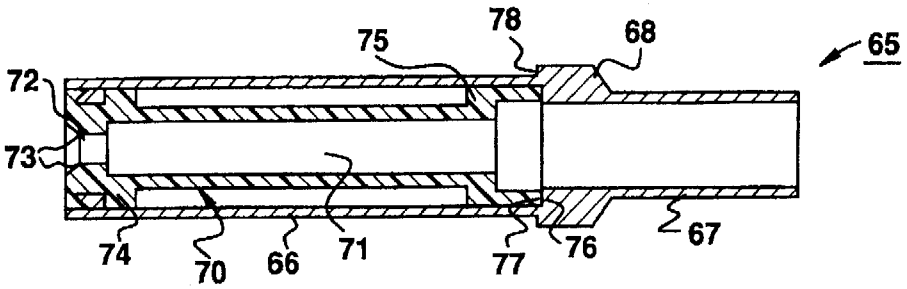
FIG. 6 is a cross-sectional side view of the intermediate contact of the triax pin of FIG. 5.
Figure 8:
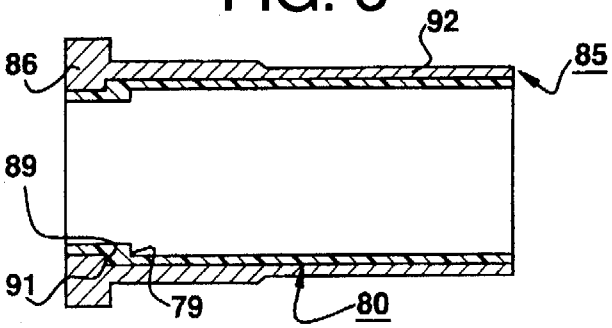
FIG. 8 is a cross-sectional side view of the outer contact portion of the triax pin assembly of FIG. 5.

The preferred socket contact assembly 10 includes an inner contact 11 having a forward mating section 12 arranged to be received by a the corresponding inner contact mating section (shown in FIGS. 5–8)of a complementary pin contact assembly and a hollow cylindrical rear section 13 arranged to receive the inner conductor 2 of the standard triax cable illustrated in FIG. 9. The inner conductor 2 is preferably soldered to the inner contact 11.

The intermediate contact of the preferred socket contact assembly 10 is preferably made up of three discrete members, an intermediate contact screen attachment member 15, an intermediate contact connecting member 30, and a hood 37. Intermediate contact screen attachment member 15 is a continuation of the triax cable intermediate screen. Connection is made between it and the intermediate contact connecting member 30 through a forward spring element 17. Forward spring element 17 is made up of at least two tines 18 extending from the main body 19 of member 15. Extending rearwardly from main body 19 is a cylindrical reduced outer diameter section 20 to which the intermediate screen 4 is secured by means of a ferrule 21, with the first dielectric 3 of the cable extending into the interior of the reduced outer diameter section. A shoulder 22 extends radially inward from the main body 19 to define the position of a dielectric member 23 for insulating the inner conductor 2 of the cable from the intermediate contact screen attachment member 15. Dielectric member 23 includes a cylindrical portion 24, the forward end 25 of which engages the rear section 13 of inner contact 11, a central passage 26 for the inner conductor 2 of the cable, and a collar 27 which engages shoulder 22. Tines 18 preferably have an extended raised surface 28 for engaging an inner surface 29 of intermediate screen connection member 30.

Intermediate screen connecting member 30 has a substantially cylindrical main section 31, an enlarged inner diameter rear section 32, and a front hood attachment section 33. The inner surface 29 of the main section accommodates the tines of the intermediate screen rear contact 15 and in addition accommodates a dielectric member 34. Member 34 insulates the inner contact from the intermediate screen connector member 30 while at the same time maintaining a sufficient distance to achieve the desired impedance and includes a passage 35 for portion 13 of the inner contact 11 and a communicating reduced diameter passage for pin portion 12.

Front hood attachment section 33 of intermediate screen connecting member 30 includes a circumferential groove 38 and has a reduced outer diameter to accommodate hood 37, which is attached to the connecting member by swaging a rear portion of the hood into groove 38. Hood 37 includes a plurality of spring tines 39 arranged to engage a corresponding intermediate contact portion of the complementary pin contact assembly.

Rear section 32 of the intermediate screen connecting member 31 has an enlarged inner diameter to accommodate an insulator member 40 for insulating the intermediate contact screen attachment and connecting members 15 and 30 from the outer contact 42. Insulator member 40 includes a forward section 43 which is received in rear section 32 of intermediate screen connecting member 30, an annular collar 44 for separating the rear surface of connecting member 30 from the front surface of outer contact 42, shoulder 45 which engages shoulder 46 of the outer contact to relatively position insulator 40 and outer contact 42, and a reduced outer diameter rear section 47 which fits into reduced inner diameter rear section 48 of the outer contact. Rear section 48 of the outer contact has a further reduced diameter section for accommodating the outer screen of the cable which attached thereto by means of crimping ferrule 49. Finally, the outer contact includes a retention shoulder 50 arranged to engage spring tines of a ground clip 88 in a connector, as described below in connection with FIGS. 10A and 10B.

Those skilled in the art will appreciate that the contact described above differs not only in structural details from the standard triax contact, but also conceptually in that the outer screen contact does not extend from the front to rear of the contact, but rather terminates well before the beginning of the inner contact, allowing the intermediate contact to have an enlarged diameter, increasing the separation between the inner and intermediate contacts in order to permit a desired separation and therefore impedance between the inner and intermediate contacts to be maintained, the intermediate contact being formed of a rear section and connecting member which engage each other via spring tines. Except that the connector needs to be modified to include a ground clip and plate in order to provide outer screen continuity through the connector shell, as well be described in more detail below, the preferred contact assembly fits within the profile of standard power contacts even while providing improved high frequency performance due to the improved impedance matching.

The preferred triax pin assembly 60 illustrated in FIGS. 5–8 utilizes the same principles as the triax socket assembly illustrated in FIGS. 1–4, i.e., termination of the outer contact to the rear of the point where the inner contact begins, in order to allow expansion of the intermediate contact while maintaining the outer diameter of the standard contact assembly. However, the structure of the pin contact assembly 60 is somewhat simpler than that of the socket contact assembly 10 because there is no need for a three part intermediate contact in this embodiment.

Triax pin contact assembly 60 includes an inner contact 61 having a spring tine portion 62 for engaging pin portion 12 of the triax socket contact assembly and, separated by a bulkhead 63, a cylindrical rear section 64 into which the inner conductor 2 of the cable is soldered and which is identical to rear section 13 of the inner contact of the socket contact assembly.

Intermediate contact 65 of triax pin contact assembly 60 includes a cylindrical forward mating portion 66, a cylindrical rear section 67, and an intermediate section 68. Forward mating portion 66 is arranged to receive an insulator member 70 having a central passage 71 for receiving the inner contact 61, a front opening 72 having beveled surfaces 73 for receiving the inner contact of the corresponding mating socket contact assembly, a collar 74 for supporting the intermediate contact forward portion, and a rear section 75 having an enlarged outer diameter for supporting the rear end of the front section 66 of the intermediate contact, and an enlarged inner diameter for receiving an end of the first dielectric 3 of the triax cable 1. Insulator 70 thus separates inner contact 61 from intermediate contact 65 to provide a desired spacing between the inner diameter of the intermediate contact and the outer diameter of the inner contact.

The rear surface 76 of insulator 70 engages a shoulder 77 of intermediate section 68, which further includes an exterior shoulder 78 for capturing a corresponding shoulder 79 on an insulator member 80. The rear section 67 of intermediate contact 65 is arranged to extend between the first dielectric 3 of the triax cable and the intermediate screen, the intermediate screen 4 being secured to the rear section by means of a crimp ferrule 81. A crimp ring 82 is fitted around the pin receiving section of the intermediate contact to which the intermediate contact's mating end is crimped, holding insulator 70 permanently inside intermediate contact 65.

Figure 10B:
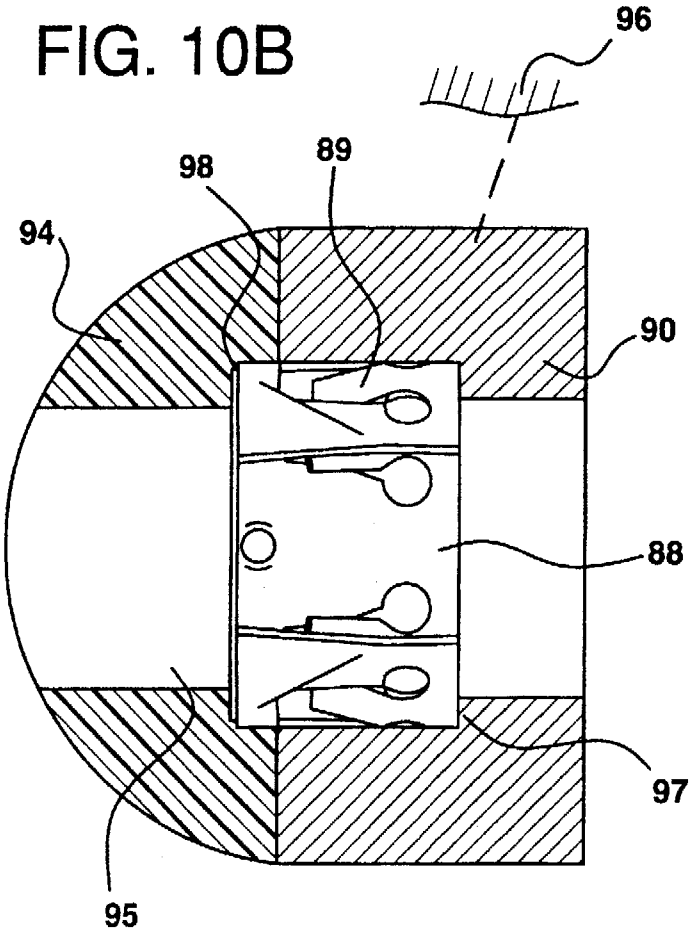
FIG. 10B is a cross-sectional side view of the grounding arrangement shown in FIG. 10A.
Figure 10A:
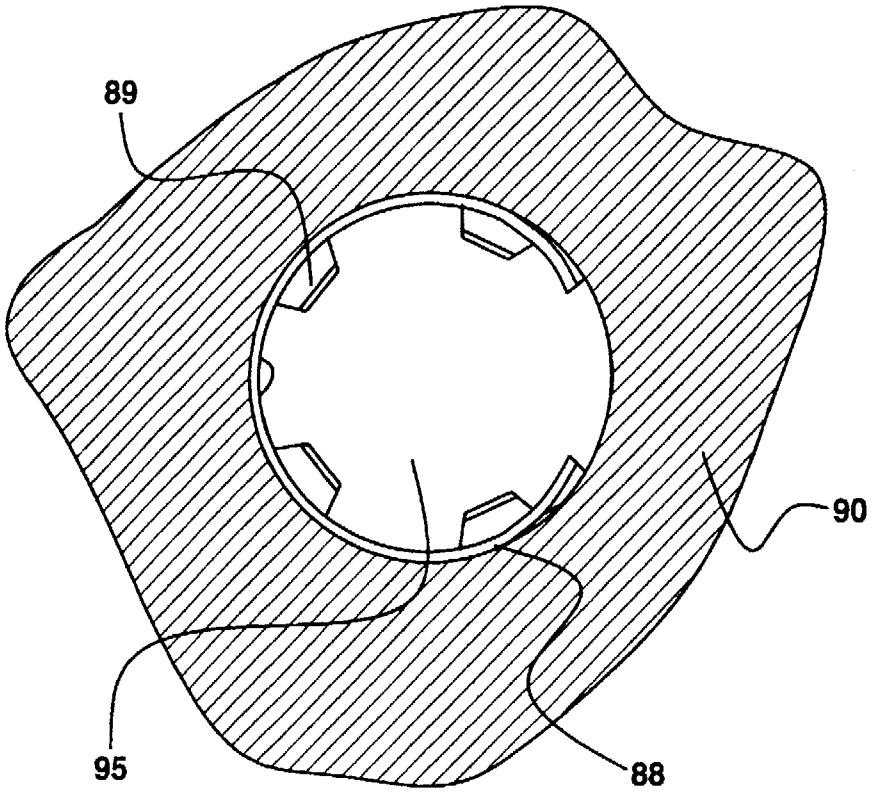
FIG. 10A is a cross-sectional end view of a grounding arrangement for use with the preferred contact assemblies.

Outer contact 85 of triax pin contact assembly 60, like corresponding outer contact 42 of the triax socket contact assembly 10, includes a flange 86 for engaging a spring clip in a connector, which may be in the form of the spring clip 88 shown in FIGS. 10A and 10B, a shoulder 89 for engaging a corresponding shoulder 91 on insulator 80, and a cylindrical reduced diameter rear section 92 to which the outer screen of the cable is crimped by means of ferrule 93. By means of flange 86, the outer contact is terminated to the connector rather than directly to a corresponding outer contact in a mating contact assembly, with outer shield continuity being maintained as described below by means of a ground path to the shells of the mating connectors.

The principal modification which needs to be made to the standard multiple contact power connector involves the addition of ground clips 88 and an insert made up of ground plate 90 and dielectric member 94, as shown in FIGS. 10A and 10B, for electrically connecting the outer screen contact of either the triax socket contact assembly or the triax pin contact assembly to the connector shell 96. Electrical continuity between the outer screens or shielding of connected cables or devices is established upon mating of conductive portions of the connector shells in conventional fashion.

Ground clips 88 of the illustrated embodiment are positioned in a groove formed by shoulders 97 and 98 on the ground plate 90 and insulator 94 and have a plurality of tines 89 which extend into the path of insertion of a contact assembly into the connector so as to engage the respective flanges 50 and 86 when the corresponding contacts are inserted through passage 95. Ground plate 90 in turn is electrically connected to the shell of the connector by means of, for example, a swaged ground strap (not shown) encircling the ground plate and which also serves to secure the ground plate/insulator insert assembly in the shell. Those skilled in the art will appreciate that the manner in which the ground plate is connected to the connector shell may be varied, and it is intended that the present invention cover all such ground plate arrangements.

The rear or termination side of the ground plate and the contact mating side of the dielectric insert 95 preferably contain silicone rubber seals for sealing around the contact assembly as well as for sealing the pin/socket interface when the connectors are mated. The insert assembly is placed into the connector shell from the rear so that a swage ring captures the insert between a forward facing shoulder of the insert assembly and a rear facing shoulder in the shell to prevent the dielectric member from being pulled from the ground plate. The dielectric member prevents the RF contact assembly's intermediate contact from having contact to shell ground.

Having thus described a preferred embodiment of the invention in sufficient detail to permit one skilled in the art to make and use the invention, those skilled in the art should nevertheless recognize that numerous variations of the preferred embodiment are possible, and that the inventors intend that the invention be defined to include all such variations.

For example, although the illustrated socket and plug assemblies correspond to size 12 Mil-C-38999 Series III size 12 power contacts, and are intermateable and intermountable with Mil qualified designs, it will be appreciated by those skilled in the art that the principles of the invention are not limited to Mil standard connectors, but may be used in a variety of military and civilian connector designs, and thus that the size and structure of the forward and/or rear interface portions of the contact assemblies may need to be varied accordingly. Consequently, it is intended that the invention not be limited to the preferred embodiment described herein and illustrated in the drawings but rather that it be limited solely by the appended claims.

We claim:

1. In a triax contact assembly for a triax cable having an inner conductor, an intermediate screen, and an outer screen, the contact assembly including an inner contact having a rear section arranged to be electrically connected to the inner conductor of the cable, an intermediate contact having a rear section arranged to be electrically connected to the intermediate screen of the cable, and an outer contact having a rear section arranged to be electrically connected to the outer screen of the cable, said inner contact, intermediate contact, and outer contact having a common axis, the improvement wherein:

the inner and intermediate contacts each have a forward mating section at a front end of the contact assembly, while the outer contact terminates short of the front end of the contact assembly and is arranged to engage a ground clip in a connector in which the contact assembly is inserted and thereby ground the outer screen of the cable to a shell of the connector rather than directly to a corresponding outer contact of a mating triax contact, and wherein the intermediate contact thereby defines an outer profile of the contact assembly forward of the outer contact to permit a defined impedance to be maintained between the inner and intermediate contacts.

2. A contact assembly as claimed in claim 1, wherein the contact assembly is a socket contact assembly, wherein the intermediate contact comprises the rear section of the intermediate contact to which the intermediate screen is terminated, and a separate connecting member electrically connected to the rear section, wherein the rear section is positioned inside the outer contact and separated therefrom by an insulator, and wherein the connecting member has an outer diameter which is larger than that of the rear section and is positioned forwardly of the outer contact and also separated from the outer contact by an insulator.

3. A contact assembly as claimed in claim 2, wherein the insulator between the connecting member and the outer contact, and the insulator between the rear section and the outer contact, are both formed by a single insulator member, the single insulator member including a cylindrical portion extending between the rear section and the outer contact and a flange extending between ends of the connecting member and the outer contact.

4. A contact assembly as claimed in claim 2, wherein the rear section is electrically connected to the connecting member by means of engagement between spring tines extending forwardly from the rear section and an inner surface of the connecting member.

5. A contact assembly as claimed in claim 2, wherein the forward mating section of the intermediate contact is a hood attached to a front section of the connecting member and arranged to mate with a corresponding intermediate contact of a mating triax pin contact assembly.

6. A contact assembly as claimed in claim 2, further comprising an insulator member positioned inside the rear section of the intermediate contact and arranged to provide passage for the inner conductor of the cable before termination to the inner contact.

7. A contact assembly as claimed in claim 2, further comprising an insulator member positioned between the inner contact and the connecting member of the intermediate contact, and forwardly of said rear section of the inner contact, the thickness of the insulator member corresponding to a desired spacing between the inner and intermediate contacts for the purpose of maintaining the desired impedance.

8. A contact assembly as claimed in claim 1, wherein said contact assembly is a triax pin contact assembly, and wherein the intermediate contact includes a cylindrical rear section and a cylindrical front section, the front section having inner and outer diameters larger than the inner and outer diameters of the rear section.

9. A contact assembly as claimed in claim 8, spacing between the outer contact and the rear section of the intermediate contact is maintained by a first insulator member, and spacing between the inner contact and the front section of the intermediate contact is maintained by a second insulator member.

10. A contact assembly as claimed in claim 1, wherein said cable has an impedance of 50Ω to gigahertz frequencies between the inner conductor and the intermediate screen, and wherein the contact assembly also has an impedance of 50Ω between the inner and intermediate contacts.

11. An electrical connector for a triax cable having an inner conductor, an intermediate screen, and an outer screen, comprising:

a contact assembly including an inner contact having a rear section arranged to be electrically connected to the inner conductor of the cable, an intermediate contact having a rear section arranged to be electrically connected to the intermediate screen of the cable, and an outer contact having a rear section arranged to be electrically connected to the outer screen of the cable, said inner contact, intermediate contact, and outer contact having a common axis, wherein:

the inner and intermediate contacts each have a forward mating section at a front end of the contact assembly, while the outer contact terminates short of the front end of the connector and is arranged to engage a ground clip in the connector and thereby ground the outer screen of the cable to a shell of the connector rather than directly to a corresponding outer contact of a mating triax contact, and wherein the intermediate contact thereby defines the outer profile of the contract assembly forward of the outer contact to permit a defined impedance to be maintained between the inner and intermediate contacts;

a ground plate arranged to be electrically connected to said shell of the connector and thereby to an outer contact of a mating connector; and a ground clip arranged to electrically connect the outer contact with the ground plate to thereby provide shielding continuity between the outer screen of the cable said and the mating connector outer contact through said ground clip, ground plate, and connector shell rather directly through engagement between the contact assembly outer contact and the mating connector outer contact.

12. A connector as claimed in claim 11, further comprising a dielectric insert affixed to the ground plate and which surrounds the intermediate contact forward of the ground plate to isolate the intermediate contact from the ground plate and connector shell, and wherein the outer contact includes a flange at a forward end of the outer contact for engaging said ground clip.

13. A connector as claimed in claim 11, wherein the contact assembly is a socket contact assembly, wherein the intermediate contact comprises the rear section of the intermediate contact to which the intermediate screen is terminated, and a separate connecting member electrically connected to the rear section, wherein the rear section is positioned inside the outer contact and separated therefrom by an insulator, and wherein the connecting member has an outer diameter which is larger than that of the rear section and is positioned forwardly of the outer contact and also separated from the outer contact by an insulator.

14. A connector as claimed in claim 13, wherein the insulator between the connecting member and the outer contact, and the insulator between the rear section and the outer contact, are both formed by a single insulator member, the single insulator member including a cylindrical portion extending between the rear section and the outer contact and a flange extending between ends of the connecting member and the outer contact.

15. A connector as claimed in claim 13, wherein the rear section is electrically connected to the connecting member by means of engagement between spring tines extending forwardly from the rear section and an inner surface of the connecting member.

16. A connector as claimed in claim 13, wherein the forward mating section of the intermediate contact is a hood attached to a front section of the connecting member and arranged to mate with a corresponding intermediate contact of a mating triax pin contact assembly.

17. A connector as claimed in claim 13, further comprising an insulator member positioned inside the rear section of the intermediate contact and arranged to provide passage for the inner conductor of the cable before termination to the inner contact.

18. A connector as claimed in claim 13, further comprising an insulator member positioned between the inner contact and the connecting member of the intermediate contact, and forwardly of said rear section of the inner contact, the thickness of the insulator member corresponding to a desired spacing between the inner and intermediate contacts for the purpose of maintaining the desired impedance.

19. A connector as claimed in claim 11, wherein said contact assembly is a triax pin contact assembly, and wherein the intermediate contact includes a cylindrical rear section and a cylindrical front section, the front section having inner and outer diameters larger than the inner and outer diameters of the rear section.

20. A contact assembly as claimed in claim 19, spacing between the outer contact and the rear section of the intermediate contact is maintained by a first insulator member, and spacing between the inner contact and the front section of the intermediate contact is maintained by a second insulator member.

21. A connector as claimed in claim 11, wherein said cable has an impedance of 50Ω to gigahertz frequencies between the inner conductor and the intermediate screen, and wherein the contact assembly also has an impedance of 50Ω between the inner and intermediate contacts.

* * * * *

UNITED STATES PATENT AND TRADEMARK OFFICE

CERTIFICATE OF CORRECTION

PATENT NO. : 5,730,623

DATED : March 24, 1998

INVENTOR(S) : Leonard A. KRANTZ

It is certified that error appears in the above-identified patent and that said Letters Patent is hereby corrected as shown below:

Column 8, line 17, change "contract" to —contact—; and

Column 8, line 27, delete "said".

Signed and Sealed this

Twenty-eighth Day of July, 1998

Bruce Lehman

*Attest:*

BRUCE LEHMAN

*Attesting Officer*

*Commissioner of Patents and Trademarks*